US006992560B2

(12) United States Patent
Yen

(10) Patent No.: US 6,992,560 B2
(45) Date of Patent: Jan. 31, 2006

(54) FUSE STRUCTURE

(76) Inventor: Chun-Chang Yen, 2F, No. 97, Sec. 4, Chong Ching North Road, Taipei City (TW)

( * ) Notice: Subject to any disclaimer, the term of this patent is extended or adjusted under 35 U.S.C. 154(b) by 0 days.

(21) Appl. No.: 10/844,413

(22) Filed: May 13, 2004

(65) Prior Publication Data

US 2005/0253679 A1 Nov. 17, 2005

(51) Int. Cl.
*H01H 39/00* (2006.01)

(52) U.S. Cl. ..... 337/203; 337/249

(58) Field of Classification Search ..... 337/249, 337/230, 281, 272

See application file for complete search history.

(56) References Cited

U.S. PATENT DOCUMENTS

| | | | | |
|---|---|---|---|---|
| 719,025 | A * | 1/1903 | Morse | 337/241 |
| 1,852,700 | A * | 4/1932 | Cote | 337/241 |
| 4,460,887 | A * | 7/1984 | McAlear et al. | 337/186 |
| 2002/0113684 | A1 * | 8/2002 | Arikawa et al. | 337/163 |

* cited by examiner

*Primary Examiner*—Anatoly Vortman
*Assistant Examiner*—Corey Broussard
(74) *Attorney, Agent, or Firm*—Rosenberg, Klein & Lee

(57) ABSTRACT

The invention relates to a fuse structure, which includes a non-conductive tube connecting both ends with two respective metal caps and an inner resistance filament being inside. The improvement is an aperture being formed on the non-conductive tube for exhausting inner heated air when welding second cap. Hence, tin for welding the cap with the tube can prevent from being extruded outside that provides fuse to be flawless and utility.

1 Claim, 3 Drawing Sheets

FUSE STRUCTURE

FIELD OF THE INVENTION

The present invention relates to a fuse structure, which is provided with an aperture on its non-conductive tube in order to facilitate in manufacturing without flaws.

BACKGROUND OF THE INVENTION

A conventional fuse includes a non-conductive tube (1), as shown in FIG. 1A, which connects one end with a metal cap (3) by welding with tin (2). A resistance filament (4) is provided therein. And then, another cap (3') is welded on the other end of the non-conductive tube (1) with tin (2') to produce a complete fuse, as in FIGS. 1B and 1C. In such manufacturing procedure, when the cap (3') is being welded, the temperature will increase and cause air in the tube (1) to expand and be pushed outwardly. The tin (2') is usually extruded and exposed outside the metal cap (3') as in FIG. 1D. This fuse is useless and is only a defeat work.

SUMMARY OF THE INVENTION

The present invention is to provide a fuse structure, which can overcome the drawback of prior art and provides a perfect product.

Now, accompanying with the following drawings, the character of the present invention will be described here and after.

DETAILED DESCRIPTION OF THE PREFERRED EMBODIMENT

Figures 1A, 1B, 1C, 1D:
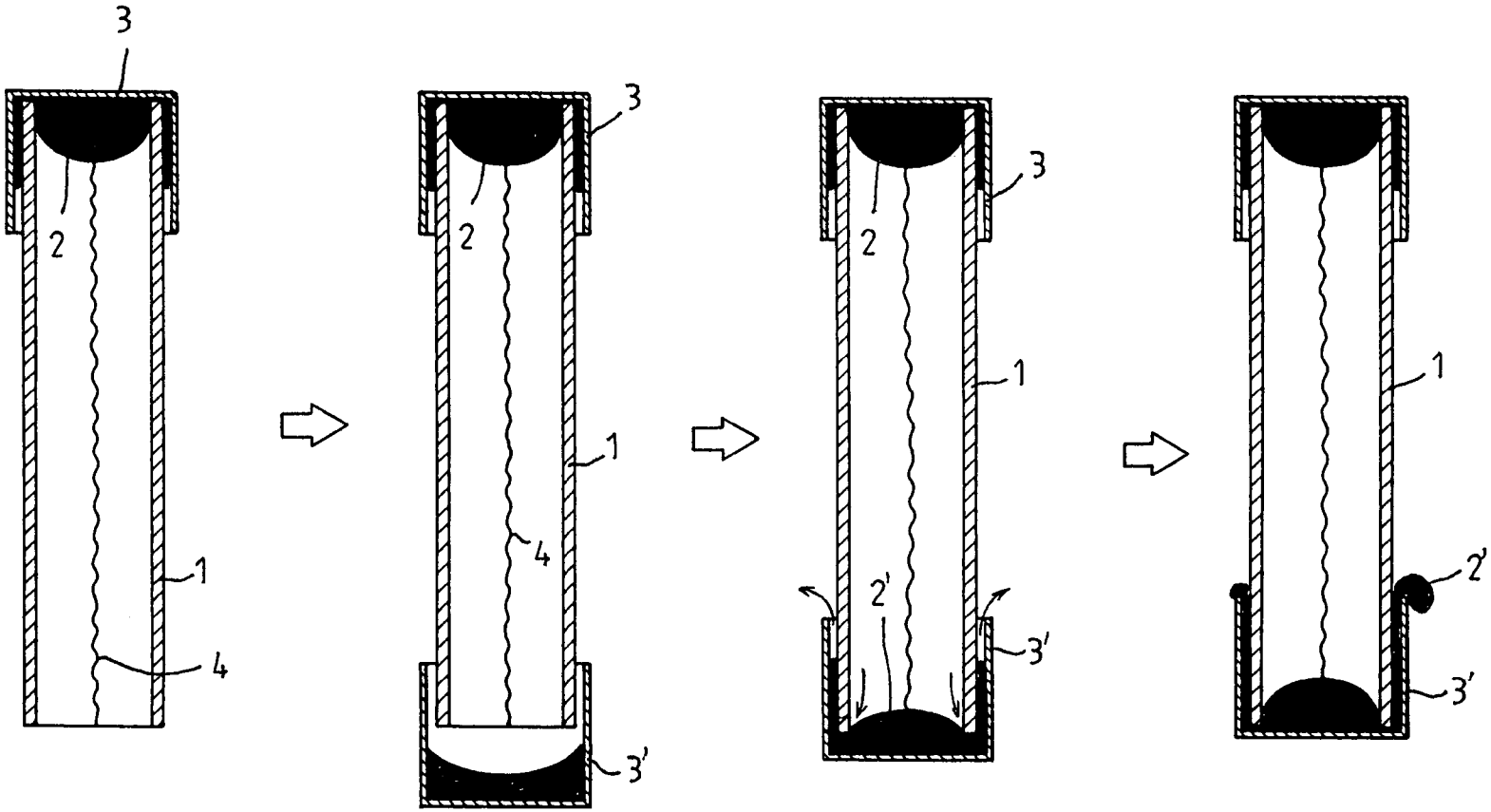
FIG. 1A FIG. 1B FIG. 1C FIG. 1D (prior art)
FIGS. 1A to 1D are cross-sectional plan view showing a conventional fuse in manufacturing procedures.
Figure 2:
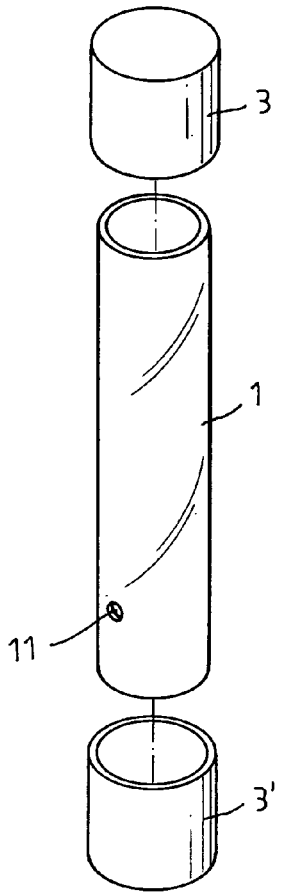
FIG. 2 is an exploded perspective view showing a fuse structure according to the present invention.
Figure 3:
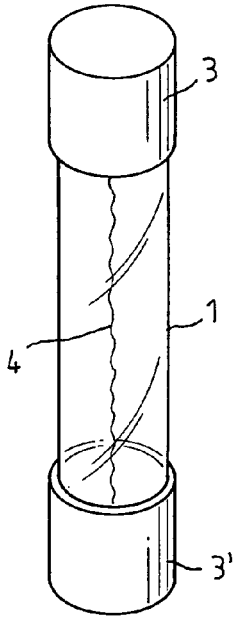
FIG. 3 is an assembled perspective view of FIG. 2.
Figure 4:
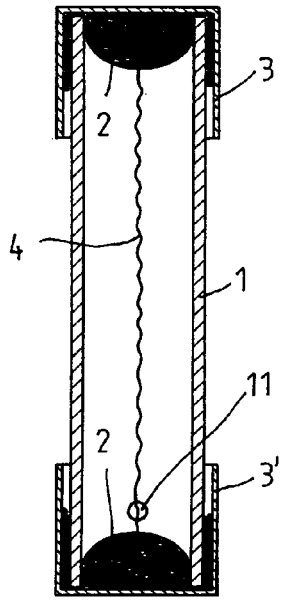
FIG. 4 is a cross-sectional plan view of FIG. 3.
Figures 5A, 5B, 5C, 5D:
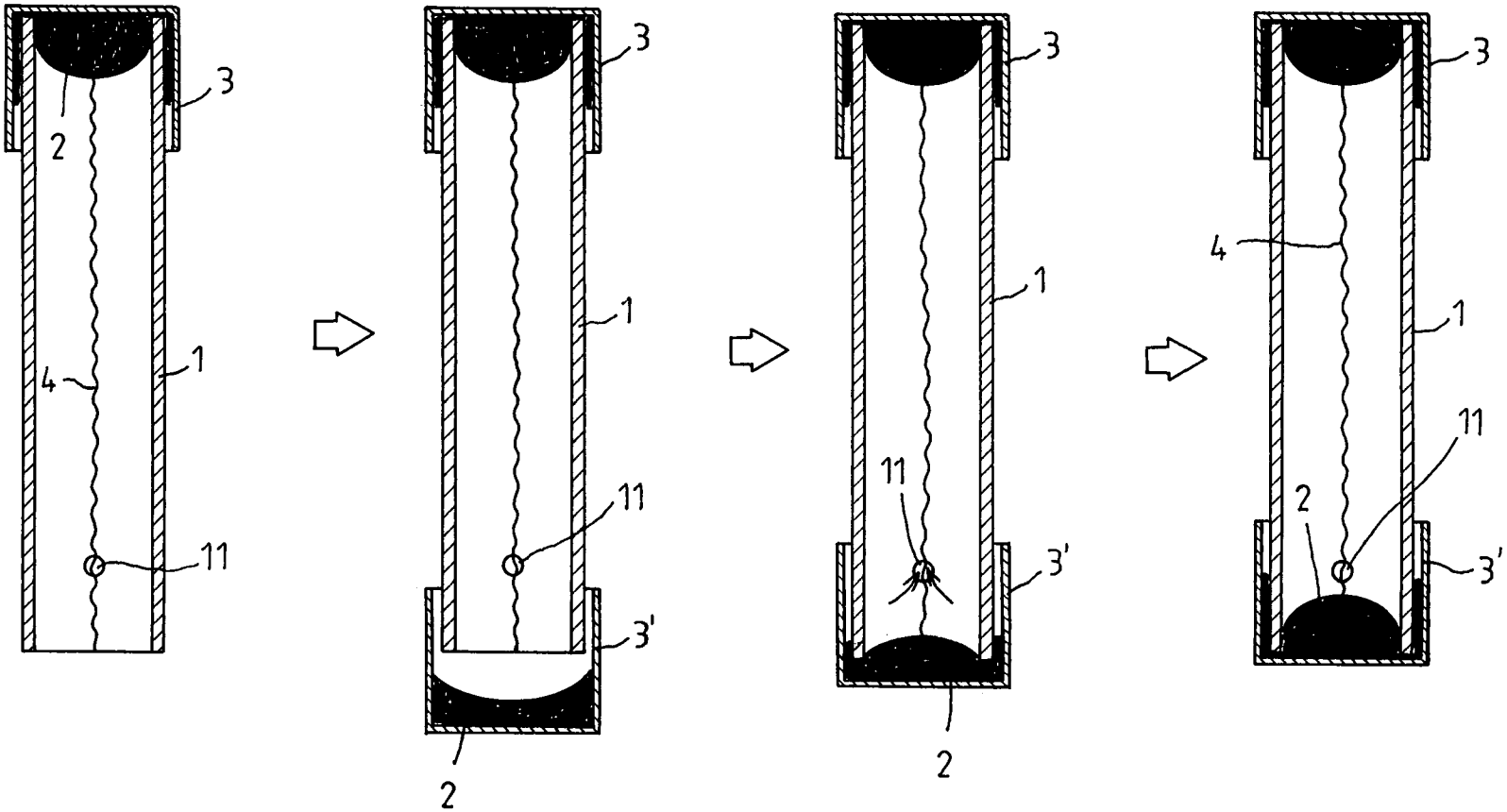
FIGS. 5A to 5D are cross-sectional plan view showing the fuse structure in manufacturing procedures according to the present invention.

Please referring to FIGS. 2 to 4, the fuse structure of the present invention includes a non-conductive tube (1), which connects both ends with two respective metal caps (3), (3') by welding tin (2), (2'). An inner resistance filament (4) is provided in the tube (1) connecting with two caps (3), (3'). The improvement of the present invention is to provide an aperture (11) on the non-conductive tube (1). The aperture (11), which can be covered by the cap (3') when it is a complete product, will be better.

In manufacturing procedures, as showing in FIGS. 5A to 5D, it can be found that heated air in the tube (1) can be exhausted through the aperture (11) when the cap (3') is welded on the tube (1). Hence, tin (2') will never be extruded outside the cap (3') and a perfect fuse is manufactured.

Accordingly, the fuse structure of the present invention can be manufactured is ease and the complete product will be flawless that reaches the purpose of patent.

I claim:

1. A fuse structure comprising a longitudinally extended non-conductive tube having a pair of opposing longitudinal ends, said non-conductive tube having an exhaust aperture formed transversely through a side thereof adjacent one of said ends, two metal caps respectively secured on said pair of ends, and a resistance filament disposed inside said non-conductive tube and respectively coupled on opposing ends to said two metal caps, said exhaust aperture being unfilled concealed by a corresponding one of said metal caps extending thereover, said aperture providing for exhausting of heated air when said corresponding metal cap is heated in a manufacturing process of said fuse structure.

* * * * *